US005664981A

United States Patent [19]

Lillo

[11] Patent Number: 5,664,981

[45] Date of Patent: Sep. 9, 1997

[54] SWIMMING AID AND METHOD OF USE

[76] Inventor: Charles Lillo, 608 E. Third, Leland, Miss. 38756

[21] Appl. No.: 714,566

[22] Filed: Sep. 16, 1996

[51] Int. Cl.[6] ..... B63C 9/08

[52] U.S. Cl. ..... 441/114; 434/254; 441/88

[58] Field of Search ..... 441/80, 88, 106, 441/110, 111, 113, 114, 115, 119, 120, 122, 129, 132, 59, 60, 108; 434/254

[56] References Cited

U.S. PATENT DOCUMENTS

| | | | |
|---|---|---|---|
| 636,893 | 11/1899 | Burton | 441/110 |
| 1,262,358 | 4/1918 | Kopec | 441/110 |
| 1,618,347 | 2/1927 | McSherry | 441/119 |
| 2,223,880 | 12/1940 | Ardern | 441/112 |
| 3,015,829 | 1/1962 | Gronkowski | 441/60 |

*Primary Examiner*—Edwin L. Swinehart
*Attorney, Agent, or Firm*—Larson and Taylor

[57] ABSTRACT

A swimming aid is provided for assisting a user in learning how to swim. The swimming aid includes a first float member having a U-shaped configuration in use. The float member is adapted to be placed against the lower back of a user, to fit around the buttocks of the user and to extend down to the thigh area of the user. Central securing straps extend, in use, around the waist of the user to secure the float member against the lower back. End securing straps are affixed to said float member at opposite ends thereof and extend, in use, around respective thighs of the user. Two further, elongate float members each include two pairs of securing straps for securing the associated float member to the upper arm and forearm of a user.

17 Claims, 2 Drawing Sheets

SWIMMING AID AND METHOD OF USE

FIELD OF THE INVENTION

The present invention relates to swimming aids, i.e., devices that assist non-swimmers, and in particular, children, in learning how to swim.

BACKGROUND OF THE INVENTION

Learning to swim can be a daunting and difficult experience for many children and young people as well as for some adults. To provide assistance in staying afloat and consequent comfort or reassurance in the water, various kinds of boards and floats have been provided so that, for example, the non-swimmer can hold on to the board or float while kicking and, in this way, become accustomed to the water and learn basic swimming strokes. So-called "water wings" have also been used for this purpose, as have conventional life jackets.

In addition to foregoing, there are, of course, a number of patents directed to swimming aids or to related devices such as life preservers and the like. These patents include the following: U.S. Pat. Nos. 3,138,809 (Bergens); 1,329,073 (Czicziriga); 1,216,457 (Jelalian); 2,223,880 (Ardern); and 1,618,347 (McSherry). Briefly considering the first three patents, the Bergens patent discloses a swimming aid which is worn on the back just above the buttocks, the Czicziriga patent discloses a swimming device wherein floats are secured to the waist and the Jelalian patent discloses a swimming device wherein floats are secured to the sides of a user by waist and leg straps. The remaining two patents are of more general interest, the Arden patent disclosing a buoyancy device which is secured around the shoulders, torso and thighs of a user and the McSherry patent disclosing a life preserver which is worn on the torso and secured to the thighs of a wearer.

SUMMARY OF THE INVENTION

In accordance with the invention, a swimming aid is provided which assists non-swimmers to stay afloat while learning how to swim. The swimming aid is not a life saving device and is not intended for use by a non-swimmer without supervision by a strong swimmer. However, the swimming aid is very helpful in teaching a non-swimmer how to swim, and, in this regard, enables a user to float both horizontally and vertically as well as assists in properly supporting the user for swimming.

A key component of the swimming aid of the invention, a U-shaped float member applied to the buttocks area of a user as described in more detail below, enables the user to float in a horizontal position and tends to gently force the upper body and head towards the water so that the user assumes the proper position for standard swimming strokes such as the crawl, breast stroke and the like. Two further float members, which are also described in more detail below, are secured to the arms so that the user is given additional support in the water and is thus made more comfortable. All three float members are quite light in weight, can be put on in a matter of seconds, are very comfortable to wear and place substantially no limits on the range of motion of a user. The increased mobility and range of motion provided by the swimming aid of the invention, as compared with most prior devices providing comparable buoyancy, enable a user to move between horizontal and vertical positions in the water with little or no effort. Moreover, a non-swimmer using the swimming aid can remain in a horizontal position on the water and not be afraid of going under water. All of this very significantly decreases the time it takes for a swimming student to learn how to swim.

In accordance with a preferred embodiment of the invention, a swimming aid is provided for assisting a user in learning how to swim, the swimming aid comprising: a first float member having a U-shaped configuration in use, and being adapted to be placed against the lower back of a user, to fit around the buttocks of the user and to extend down to the thigh area of the user; securing means, affixed to a central portion of the float member and extending, in use, around the waist of the user, for securing the float member against the lower back of the user, and further securing means, affixed to the float member at opposite ends thereof and extending, in use, around respective thighs of the user, for securing the opposite ends of the float member to the respective thighs of the user. In a preferred implementation, the swimming aid of the invention further comprises first and second further, elongate float members, these further float members each comprising a first securing means at one end thereof for securing that further float member to the upper arm of the user and a second securing means at the opposite end thereof for securing that further float member to the forearm of the user.

Advantageously, the securing means affixed to the central portion of the first float member comprises a pair of straps, and one strap of the pair of straps includes a hooks fastener at the distal end thereof and the other strap of the pair of straps including a loops fastener at the distal end thereof. The central portion of the first float member preferably includes a plurality of spaced holes extending therethrough and the straps comprise free ends of a strap element having a central part threaded through the holes in the float member.

The first and second securing means of the further float members each preferably comprise a pair of straps, with one strap of each of the pairs of straps including a hooks fastener at the distal end thereof and the other strap of each of the pairs of straps including a loops fastener at the distal end thereof. The further float members each preferably includes a pair of spaced holes therein, and each of the pairs of straps comprises free ends of a strap element having a central part threaded through those spaced holes.

In accordance with a further aspect of the invention, a method is provided for assisting a person in learning how to swim, the method comprising: securing a lightweight U-shaped float member to the lower back area of the person by affixing straps, connected to a central portion of the float member, around the waist of the person and affixing further straps connected to opposite ends of the float member around the thighs of the person so that, in use in the water, the float member will provide a buoyant force in the buttocks area of the person so as to assist the person in floating and swimming.

The straps connected to the central portion of the U-shaped float member preferably comprise a pair of straps including cooperating hooks and loops fasteners, and the affixing of the straps around the waist of the person comprises affixing said hooks and loops fasteners together. Similarly, the further straps connected to opposite ends of the float member comprise a pair of straps including cooperating hooks and loops fasteners, and the affixing of the further straps around the thighs of the person comprises affixing these hooks and loops fasteners together.

In a preferred implementation of this aspect of the invention, the method further comprises securing a further, elongate float member to each arm of the person, the securing of a further float member to each arm preferably comprises placing the further float member along the length of the arm of the person and securing one end of the further member to the upper arm of the person and securing the opposite end of the further member to the lower arm of the person.

Other features and advantages of the invention will be set forth in, or apparent from, the following detailed description of the preferred embodiment of the invention.

DESCRIPTION OF THE PREFERRED EMBODIMENTS

Figure 1:
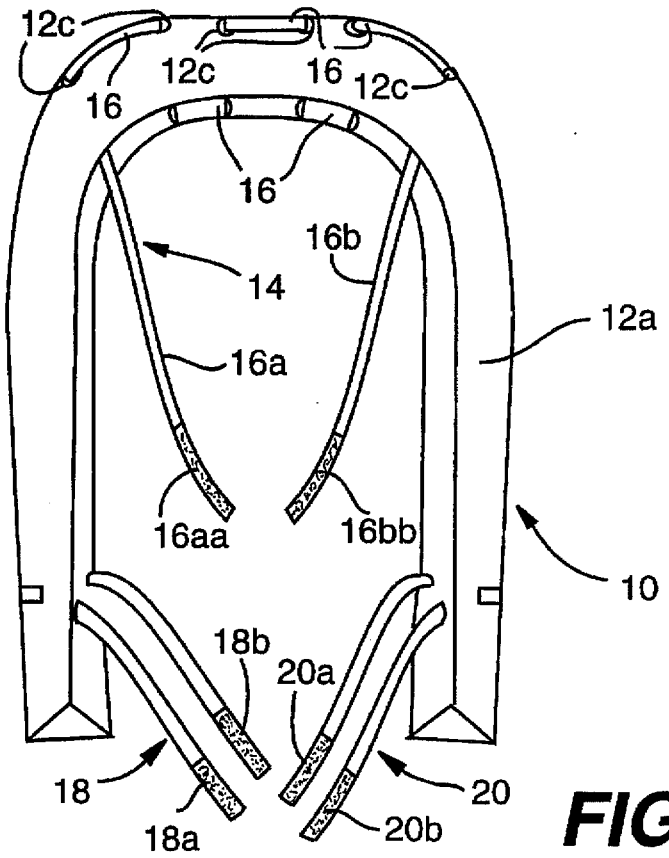
FIG. 1 is a top plan view of one component of the swimming aid of the invention.

Referring to FIG. 1, there is shown a swimming aid, generally denoted 10, constructed in accordance with a first embodiment of the invention. Swimming aid 10 includes an elongate float member 12 which is made of a lightweight buoyant material and preferably comprises a generally U-shaped plastic tube or cushion filled with air. Float member 12 includes a rounded outer side or portion 12*a* and a flat inner side or portion 12*b* which, as is explained below, is adapted to fit against the body of a user, i.e., a person learning to swim. It is noted that the showing of swim aid 10 in FIG. 1 is somewhat skewed in order to show all of the elements thereof.

Although an air-filled tube as described above is preferred, float member 12 can either be formed or molded into a permanent U-shaped configuration or can be flexible enough to permit subsequent bending thereof in such a configuration.

A first strap assembly 14 is provided in a central area of float 12 and, in the illustrated embodiment, comprises a connector strap 16 which is threaded or laced through longitudinally spaced holes 12*c* so that the free ends thereof, 16*a* and 16*b*, extend outwardly of flat inner surface 12*b*. Holes 12*c* are disposed along the curved central portion of float member and each extends between the outer surface of rounded side 12*a* and the outer surface of flat side 12*b* so as to permit the lacing or threading of strap 16 described above. Holes 12*c* are spaced apart to ensure that the strap-forming free ends 16*a* and 16*b* exit from the flat side 12*b* with substantial spacing therebetween. The strap-forming free ends 16*a* and 16*b* are respectively provided with a conventional hooks fastener and a conventional loops fastener, indicated at 16*aa* and 16*bb*, so that these ends can be readily and easily be joined together and detached from one another.

Two further securing means, in the form of pairs of connector straps 18 and 20, are provided at the opposite end of float member 12. Straps 18 and 20 are each threaded through a pair of spaced holes 12*d* in float member 12 so that the free ends thereof, 18*a* and 18*b*, and 20*a* and 20*b*, extend outwardly from the flat inner surface 12*b* of float member 12. These pairs of free ends include respective hooks and loops fasteners 18*aa*, 18*bb*, 20*aa* and 20*bb*.

Figure 2:
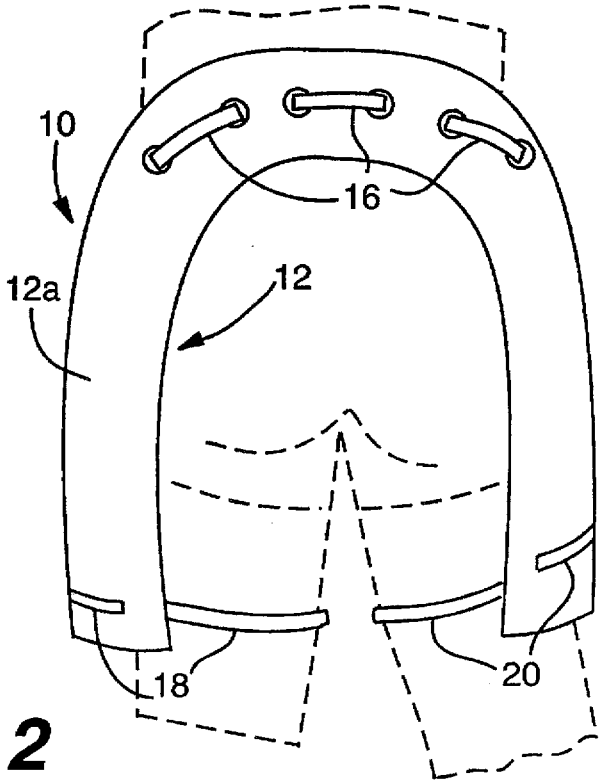
FIGS. 2 and 3 are rear and front views, respectively, showing the component of FIG. 1 in use.
Figure 3:
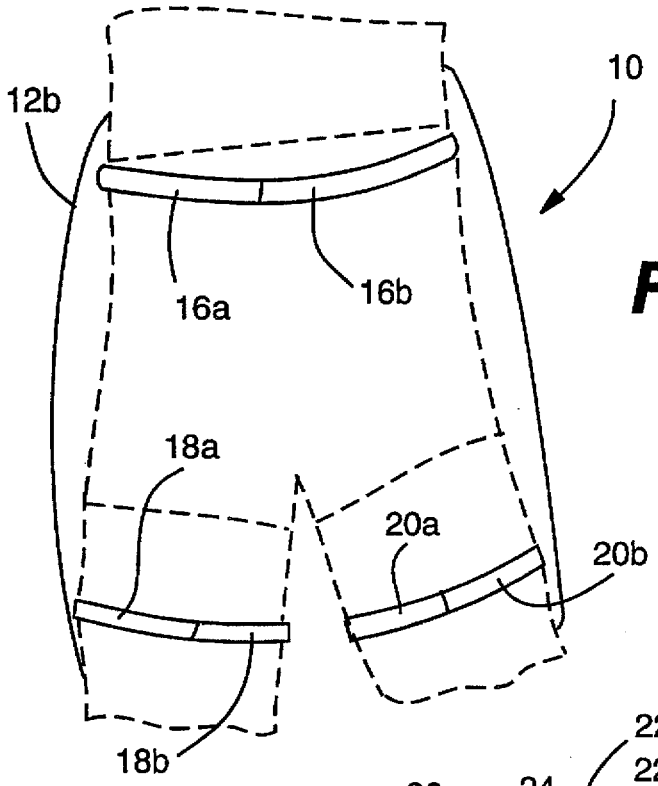

As shown in FIGS. 2 and 3, in use, swim aid 10 is secured to the body of a user in the area of the buttocks with the central portion of float member 12 fitting against the lower back and the end portions or legs of U-shaped configuration formed by float member 12 generally framing the buttocks and extending down to the thigh area of the user. As shown, straps 16*a* and 16*b* fit around the waist of the user and serve to secure the central portion of float member 12 in place while straps 18*a*, 18*b* and 20*a*, 20*b* fit around respective inner thighs of the user and secure the free, lower ends of float member 12 in place.

Figure 4:
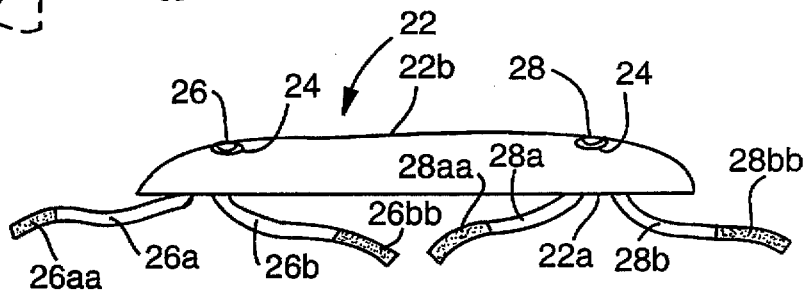
FIGS. 4 and 5 are a side elevational view and a top plan view, respectively, of a further component of the swimming aid of the invention.
Figure 5:
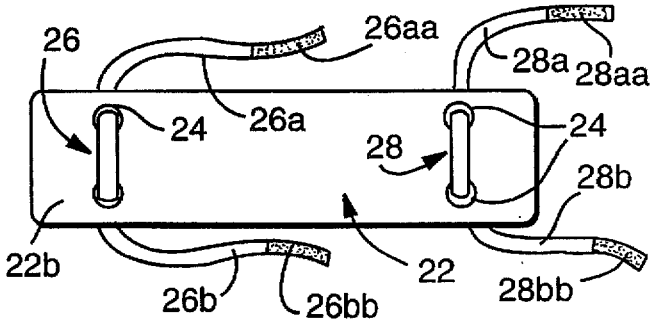

Referring to FIG. 4 and 5, a further component of the swimming aid of the invention is shown. Two such components are provided, one for each arm, and each component comprises, as illustrated, an elongate float member 22 having a substantially flat side 22*a* and a rounded side 22*b*. Pairs of spaced hole 24 are provided in float member 22 at opposite ends thereof and first and second strap members 26 and 28 are threaded or laced, through respective pairs of these holes 24 so that strap-forming free ends, viz., straps 26*a*, 26*b* and 28*a*, 28*b*, exit from flat side 22*a*. Hooks fasteners and loops fasteners, indicated at 26*aa*, 26*bb* and 28*aa*, 28*bb* are provided at respective distal ends of straps 26*a*, 26*b* and 28*a*, 28*b*.

Figure 6:
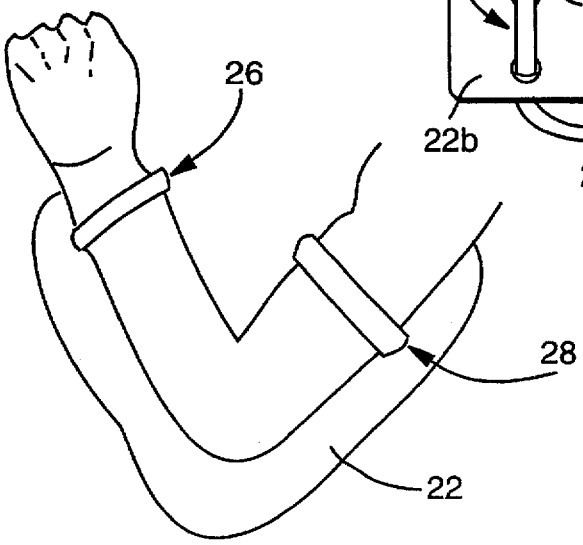
FIG. 6 is a side view, showing the component of FIGS. 4 and 5 in use.

As shown in FIG. 6, strap member 26 of float member 22 is secured around the lower arm or forearm of a user while strap member 28 is secured around the upper arm or bicep. As noted above, components corresponding to float member 22 would be secured to each arm of a user.

Although in accordance with a preferred, particularly advantageous embodiment of the invention, all three components or pieces (corresponding to float member 12 and to two float members 22) would be provided or employed, it is to be understood that float member 12 can be used without the arm components and still provide valuable assistance to the user with respect to support, positioning and comfort in the water.

Although the present invention has been described to specific exemplary embodiments thereof, it will be understood by those skilled in the art that variations and modifications can be effected in these exemplary embodiments without departing from the scope and spirit of the invention.

What is claimed is:

1. A swimming aid for assisting a user in learning how to swim, said swimming aid comprising:

a float member having a U-shaped configuration in use, and being adapted to be placed against the lower back of a user, to fit around the buttocks of the user and to extend down to the thigh area of the user;

securing means, affixed to a central portion of said float member and extending, in use, around the waist of the user, for securing the float member against the lower back of the user, and further securing means, affixed to said float member at opposite ends thereof and extending, in use, around respective thighs of the user, for securing said opposite ends of said float member to the respective thighs of the user.

2. A swimming aid as claimed in claim 1 further comprising first and second further, elongate float members, said further float members each comprising a first securing means at one end thereof for securing that further float member to the upper arm of a user and a second securing means at the opposite end thereof for securing that further float member to the forearm of a user.

3. A swimming aid as claimed in claim 1 wherein said securing means affixed to said central portion comprises a pair of straps, one strap of said pair of straps including a hooks fastener at the distal end thereof and the other strap of said pair of straps including a loops fastener at the distal end thereof.

4. A swimming aid as claimed in claim 3 wherein said central portion of said float member includes a plurality of spaced holes extending therethrough and said straps comprise free ends of a strap element having a central part threaded through said holes in said float member.

5. A swimming aid as claimed in claim 2 wherein said first and second securing means of said further float members each comprise a pair of straps, one strap of each of said pairs of straps including a hooks fastener at the distal end thereof and the other strap of each of said pairs of straps including a loops fastener at the distal end thereof.

6. A swimming aid as claimed in claim 5 wherein said ends of said further float members each include a pair of spaced holes therein and each of said pairs of straps comprises free ends of a strap element having a central part threaded through said spaced holes.

7. A swimming aid for assisting a user in learning how to swim, said swimming aid comprising:

a float member having a U-shaped configuration in use, and being adapted to be placed against the lower back of a user, to fit around the buttocks of the user and to extend down to the thigh area of the user; central securing means affixed to a central portion of said float member and extending, in use, around the waist of the user for securing the float member against the lower back of the user, and end securing means, affixed to said float member at opposite ends thereof and extending, in use, around respective thighs of the user, for securing said opposite ends of said float member to the respective thighs of the user, and first and second further, elongate float members, said further float members each comprising a first securing means at one end thereof for securing that further float member to the upper arm of a user and a second securing means at the opposite end thereof for securing that further float member to the forearm of a user.

8. A swimming aid as claimed in claim 7 wherein said central securing means and said end securing means each comprise a pair of straps, one strap of said pair of straps including a hooks fastener at the distal end thereof and the other strap of said pair of straps including a loops fastener at the distal end thereof.

9. A swimming aid as claimed in claim 8 wherein said central portion of said float member includes a plurality of spaced holes extending therethrough and said straps of said central securing means comprise free ends of a strap element having a central part threaded through said holes in said float member.

10. A swimming aid as claimed in claim 9 wherein said first and second securing means of said further float members each comprise a pair of straps, one strap of each of said pairs of straps including a hooks fastener at the distal end thereof and the other strap of each of said pairs of straps including a loops fastener at the distal end thereof.

11. A swimming aid as claimed in claim 10 wherein said ends of said further float members each includes a pair of spaced holes therein and each of said pairs of straps comprises free ends of a strap element having a central part threaded through said spaced holes.

12. A method for assisting a person in learning how to swim, said method comprising:

securing a lightweight U-shaped float member to the lower back area of the person by affixing straps, connected to a central portion of the float member, around the waist of the person and affixing further straps connected to opposite ends of the float member around the thighs of the person so that, in use in the water, the float member will provide a buoyant force in the buttocks area of the person so as to assist the person in floating and swimming.

13. A method as claimed in claim 12 wherein said straps connected to said central portion of said U-shaped float member comprise a pair of straps including cooperating hooks and loops fasteners, and said affixing of said straps around the waist of the person comprises affixing said hooks and loops fasteners together.

14. A method as claimed in claim 12 wherein said further straps connected to opposite ends of the float member comprise a pair of straps including cooperating hooks and loops fasteners, and said affixing of said further straps around the thighs of the person comprises affixing said hooks and loops fasteners together.

15. A method as claimed in claim 12, further comprising securing a further, elongate float member to each arm of the person.

16. A method as claimed in claim 15 wherein said securing a further float member to each arm comprises placing said further float member along the length of the arm of the person and securing one end of said further member to the upper arm of the person and securing the opposite end of said further member to the lower arm of the person.

17. A method as claimed in claim 15, wherein said securing a further float member to each arm comprises affixing straps attached to one end of said further float member to the upper arm of the person and affixing straps attached to the other end of said further float member to the forearm of the person.

* * * * *